US007749671B2

(12) United States Patent
Yamamoto et al.

(10) Patent No.: US 7,749,671 B2
(45) Date of Patent: Jul. 6, 2010

(54) TONER FOR DEVELOPING A LATENT ELECTROSTATIC IMAGE, IMAGE-FORMING METHOD, IMAGE-FORMING APPARATUS AND PROCESS CARTRIDGE USING THE SAME

(75) Inventors: Atsushi Yamamoto, Kawanishi (JP); Masahide Inoue, Katsuragi (JP); Chiyoshi Nozaki, Otsu (JP); Minoru Nakamura, Takarazuka (JP); Masayuki Hagi, Minoo (JP); Yoshihiro Mikuriya, Nishinomiya (JP); Tsuyoshi Nozaki, Ikedai (JP); Hiroaki Kato, Nagaokakyo (JP); Takuya Kadota, Kobe (JP); Katsunori Kurose, Takarazuka (JP); Hideaki Yasunaga, Ibaraki (JP); Yoshimichi Ishikawa, Itami (JP)

(73) Assignee: Ricoh Company, Ltd., Tokyo (JP)

( * ) Notice: Subject to any disclaimer, the term of this patent is extended or adjusted under 35 U.S.C. 154(b) by 861 days.

(21) Appl. No.: 11/521,385

(22) Filed: Sep. 15, 2006

(65) Prior Publication Data

US 2007/0059625 A1 Mar. 15, 2007

(30) Foreign Application Priority Data

Sep. 15, 2005 (JP) ..... 2005-269168
Aug. 28, 2006 (JP) ..... 2006-230902

(51) Int. Cl.
*G03G 9/08* (2006.01)

(52) U.S. Cl. ..... 430/108.6; 430/108.7

(58) Field of Classification Search ..... 430/108.6, 430/108.7
See application file for complete search history.

(56) References Cited

U.S. PATENT DOCUMENTS 5,281,505 A * 1/1994 Inoue et al. ..... 430/108.3

(Continued)

FOREIGN PATENT DOCUMENTS

EP 575805 A1 * 12/1993

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

(Continued)

*Primary Examiner*—Christopher RoDee
(74) *Attorney, Agent, or Firm*—Oblon, Spivak, McClelland, Maier & Neustadt, L.L.P.

(57) ABSTRACT

To provide a toner containing at least a toner base containing a binder resin and a colorant, and an inorganic fine particle, wherein the inorganic fine particle contains a compound oxide expressed by the following Composition Formula (1):

$$[M1]_aSi_bO_c \qquad \text{Composition Formula (1)}$$

where "M1" represents a metal element selected from Sr, Mg, Zn, Co, Mn and Ce, "a" and "b" each represents an integer of 1 to 9 and "c" represents an integer of 3 to 9, wherein an average primary particle diameter of the compound oxide is 0.02 μm to 1.5 μm, and an average secondary particle diameter of the compound oxide is 0.08 μm to 3.5 μm, where the secondary particle is an aggregate of the primary particles.

9 Claims, 2 Drawing Sheets

U.S. PATENT DOCUMENTS

| | | | | |
|---|---|---|---|---|
| 5,342,876 | A * | 8/1994 | Abe et al. | 524/493 |
| 5,695,902 | A * | 12/1997 | Mikuriya et al. | 430/108.6 |
| 5,858,597 | A * | 1/1999 | Mizoh et al. | 430/108.6 |
| 5,989,768 | A * | 11/1999 | Little | 430/108.24 |
| 6,060,202 | A * | 5/2000 | Ogawa et al. | 430/108.3 |
| 2003/0138715 | A1* | 7/2003 | Barthel et al. | 430/108.3 |
| 2003/0138716 | A1* | 7/2003 | Konya et al. | 430/108.6 |
| 2005/0058926 | A1* | 3/2005 | Kawakami et al. | 430/108.7 |
| 2005/0112488 | A1* | 5/2005 | Yamada et al. | 430/108.7 |
| 2008/0199234 | A1 | 8/2008 | Hagi et al. | |

FOREIGN PATENT DOCUMENTS

| | | | |
|---|---|---|---|
| JP | 5-165257 | | 7/1993 |
| JP | 2754619 | | 3/1998 |
| JP | 10161336 | A * | 6/1998 |
| JP | 11-95479 | | 4/1999 |
| JP | 11-95480 | | 4/1999 |
| JP | 2933724 | | 5/1999 |
| JP | 11-194525 | | 7/1999 |
| JP | 3007693 | | 11/1999 |
| JP | 2000-98650 | | 4/2000 |
| JP | 2000-98665 | | 4/2000 |
| JP | 2002-31913 | | 1/2002 |
| JP | 3299199 | | 4/2002 |
| JP | 2003-327470 | | 11/2003 |
| JP | 2005-130691 | | 5/2005 |

OTHER PUBLICATIONS

Owen, David. Copies in Seconds. New York: Simon and Schuster Paperbacks. (2004) pp. 166-175.*

English language machine translation of JP 10-161336 (Jun. 1998).*

U.S. Appl. No. 11/924,994, filed Oct. 26, 2007, Katoh, et al.
U.S. Appl. No. 11/696,879, filed Apr. 5, 2007, Yasunaga, et al.
U.S. Appl. No. 11/772,404, filed Jul. 2, 2007, Nakamura, et al.
U.S. Appl. No. 11/779,648, filed Jul. 18, 2007, Yamamoto, et al.
U.S. Appl. No. 11/855,739, filed Sep. 14, 2007, Fuwa, et al.
U.S. Appl. No. 11/851,048, filed Sep. 6, 2007, Murakami, et al.
U.S. Appl. No. 11/851,617, filed Sep. 7, 2007, Murakami, et al.
U.S. Appl. No. 11/854,783, filed Sep. 13, 2007, Nakamura, et al.
U.S. Appl. No. 11/855,759, filed Sep. 14, 2007, Katoh, et al.
U.S. Appl. No. 11/856,248, filed Sep. 17, 2007, Murakami, et al.
U.S. Appl. No. 12/048,865, filed Mar. 14, 2008, Yasunaga, et al.
U.S. Appl. No. 11/857,175, filed Sep. 18, 2007, Matsumoto, et al.
U.S. Appl. No. 11/963,279, filed Dec. 21, 2007, Mikuriya, et al.
U.S. Appl. No. 11/965,522, filed Dec. 27, 2007, Fuwa, et al.
U.S. Appl. No. 12/017,853, filed Jan. 22, 2008, Masumoto, et al.
U.S. Appl. No. 12/026,057, filed Feb. 5, 2008, Nozaki, et al.
U.S. Appl. No. 12/035,892, filed Feb. 22, 2008, Kadota, et al.
U.S. Appl. No. 12/046,784, filed Mar. 12, 2008, Nozaki, et al.
U.S. Appl. No. 12/046,866, filed Mar. 12, 2008, Matsumoto, et al.
U.S. Appl. No. 12/048,689, filed Mar. 14, 2008, Kadota, et al.
U.S. Appl. No. 12/049,719, filed Mar. 17, 2008, Yamamoto, et al.
U.S. Appl. No. 12/050,663, filed Mar. 18, 2008, Izutani, et al.
U.S. Appl. No. 12/050,963, filed Mar. 19, 2008, Ishikawa, et al.
U.S. Appl. No. 12/051,248, filed Mar. 19, 2008, Hagi, et al.
U.S. Appl. No. 12/010,369, filed Jan. 24, 2008, Yasunaga, et al.
U.S. Appl. No. 12/027,704, filed Feb. 7, 2008, Fuwa, et al.
U.S. Appl. No. 12/043,633, filed Mar. 6, 2008, Nakamura, et al.
U.S. Appl. No. 12/046,869, filed Mar. 12, 2008, Nozaki, et al.

* cited by examiner

TONER FOR DEVELOPING A LATENT ELECTROSTATIC IMAGE, IMAGE-FORMING METHOD, IMAGE-FORMING APPARATUS AND PROCESS CARTRIDGE USING THE SAME

BACKGROUND OF THE INVENTION

1. Field of the Invention

The present invention relates to a toner for developing a latent electrostatic image, which does not cause toner spillage from a developing unit and formation of streaks on a toner bearing member (hereinafter, referred to as "toner conveying member" and "developing roller") due to operation of an image-forming apparatus for a long period of time, and does not impair image quality, and the present invention also relates an image-forming method, an image-forming apparatus and a process cartridge using the toner.

2. Description of the Related Art

Currently, there is a trend that a full-color print replaces a monochrome print in copiers, printers and Multifunction Peripherals (MFP) using an electrophotographic method.

Above all, the printers and MFPs which are used in Small Office Home Office (SOHO) or placed dispersively in an office are shipped in large volume. For these applications low price and compact ones are desired. The printers and MFPs employing a nonmagnetic one-component developing process are advantageous to meet such needs because they are constructed from small number of components, and do not need a space for mixing with magnetic particles.

The nonmagnetic one-component developing process is performed by the following steps: applying charge to a toner by friction by means of a toner layer thickness control member contacting with a toner bearing member (developing roller) (frictional charge), simultaneously coating the toner bearing member thinly with the toner, and then conveying the toner to a developing area in which the toner bearing member and a image bearing member face each other, and developing a latent electrostatic image on the image bearing member to be visible as a toner image.

However, in the nonmagnetic one-component developing process, the following phenomena may occur: a phenomenon of toner spilling from between the toner layer thickness control member and the toner bearing member in a developing unit, which is termed as "toner spillage"; and a phenomenon of the toner lacking streaky in a circumferential direction on the toner bearing member, which is termed as "streaks on the toner bearing member". When toner spillage occurs, the inside of the device such as a printer, a MFP and the like are smeared by the toner. This may cause not only smear on print, and on hands or clothes of a user when the user replaces consumable supplies such as a toner bottle, toner cartridge, and process cartridge, but also device failure due to contact failure of an electrode contact point and torque up of a moving portion. Moreover, when streaks occur on the toner bearing member, a streaky image failure is generated on a print, and print quality is significantly impaired.

The toner spillage can be reduced to some extend by strengthening the contact pressure between the toner layer thickness control member and the toner bearing member. However, a part of the toner component is fused in the contact part between the toner layer thickness control member and the toner bearing member due to excessive contact pressure, and the toner cannot be coated uniformly on the toner bearing member. Thus the toner is frictionally charged unevenly, and the poorly charged toner adheres around the non-image portion of a print (toner fog).

To solve the above problem, it has been reported that the mixing of magnesium silicates such as forsterite, enstatite, steatite and the like in a toner base allows to improve the effect (For example, Japanese Patent Application Laid-Open (JP-A) No. 05-165257, Japanese Patent (JP-B) Nos. 2933724 and 3007693). The magnesium silicate herein is $MgO—SiO_2$ oxide (see Japanese Patent Application Laid-Open (JP-A) No. 2003-327470).

Even though the image-forming apparatus using the toner base in which the magnesium silicate is mixed in the above proposals, problems of the toner spillage from a developing unit and streaks on the toner bearing member occur when it is operated for a long period of time.

SUMMARY OF THE INVENTION

An object of the present invention is to provide a toner for developing a latent electrostatic image, which does not cause toner spillage from a developing unit and formation of streaks on a toner bearing member, and does not impair an image quality due to operation of an image-forming apparatus for a long period of time, and to provide an image-forming method, an image-forming apparatus and a process cartridge using the toner.

A toner of the present invention contains at least a toner base containing a binder resin and a colorant, and an inorganic fine particle, wherein the inorganic fine particle contains a compound oxide expressed by the following Composition Formula (1):

$$[M1]_aSi_bO_c \qquad \text{Composition Formula (1)}$$

where "M1" represents a metal element selected from Sr, Mg, Zn, Co, Mn and Ce, "a" and "b" each represents an integer of 1 to 9 and "c" represents an integer of 3 to 9, wherein an average primary particle diameter of the compound oxide is 0.02 μm to 1.5 μm, and an average secondary particle diameter of the compound oxides is 0.08 μm to 3.5 μm, where the secondary particle is an aggregate of the primary particles.

The present invention can provide a toner for developing a latent electrostatic image with which an image quality is not impaired in spite of use of an image-forming apparatus for a long period of time.

An image-forming method of the present invention contains at least charging a surface of an image bearing member, exposing the charged surface of the image bearing member to form a latent electrostatic image, developing the latent electrostatic image using a toner to form a visible image, transferring the visible image to a recording medium, and fixing the transferred image on the recording medium, wherein the toner contains at least a toner base containing a binder resin and a colorant, and an inorganic fine particle, wherein the inorganic fine particle contains a compound oxide expressed by the following Composition Formula (1):

$$[M1]_aSi_bO_c \qquad \text{Composition Formula (1)}$$

where "M1" represents a metal element selected from Sr, Mg, Zn, Co, Mn and Ce, "a" and "b" each represents an integer of 1 to 9 and "c" represents an integer of 3 to 9, wherein an average primary particle diameter of the compound oxide is 0.02 μm to 1.5 μm, and an average secondary particle diameter of the compound oxides is 0.08 μm to 3.5 μm, where the secondary particle is an aggregate of the primary particles.

The present invention can provide an image-forming method with which an image quality is not impaired in spite of use of an image-forming apparatus for a long period of time, and a stable printing can be maintained.

An image-forming apparatus of the present invention contains at least an image bearing member, a charging unit which is disposed so as to contact with the image bearing member, and is configured to charge the surface of the image bearing member at a predetermined potential, an exposing unit configured to expose the charged surface of the image bearing member to form a latent electrostatic image, a developing unit configured to develop the latent electrostatic image using a toner to form a visible image, a transferring unit configured to transfer the visible image to a recording medium, wherein the developing unit contains a rotatable toner conveying member and a toner supplying member which supplies the toner to the toner conveying member, and the toner is the toner of the present invention.

The present invention can provide an image-forming apparatus in which an image quality is not impaired in spite of use of a image-forming apparatus for a long period of time, and a stable printing can be maintained.

An process cartridge of the present invention contains at least an image bearing member, a charging unit which is disposed so as to contact with the image bearing member, and configured to charge the surface of the image bearing member at a predetermined potential, a developing unit configured to develop the latent electrostatic image using a toner to form a visible image, wherein the developing unit containing a rotatable toner conveying member and a toner supplying member which supplies a toner to the toner conveying member, wherein the process cartridge is detachably attached to an image-forming apparatus, wherein the toner contains at least a toner base containing a binder resin and a colorant, and an inorganic fine particle, wherein the inorganic fine particle contains a compound oxide expressed by the following Composition Formula (1):

$$[M1]_a Si_b O_c \qquad \text{Composition Formula (1)}$$

where "M1" represents a metal element selected from Sr, Mg, Zn, Co, Mn and Ce, "a" and "b" each represents an integer of 1 to 9 and "c" represents an integer of 3 to 9, wherein an average primary particle diameter of the compound oxide is 0.02 μm to 1.5 μm, and an average secondary particle diameter of the compound oxides is 0.08 μm to 3.5 μm, where the secondary particle is an aggregate of the primary particles.

The present invention can provide a process cartridge with which an image quality is not impaired in spite of use of the image-forming apparatus for a long period of time, and a stable printing can be maintained.

DESCRIPTION OF THE PREFERRED EMBODIMENTS (Toner)

Figure 1:
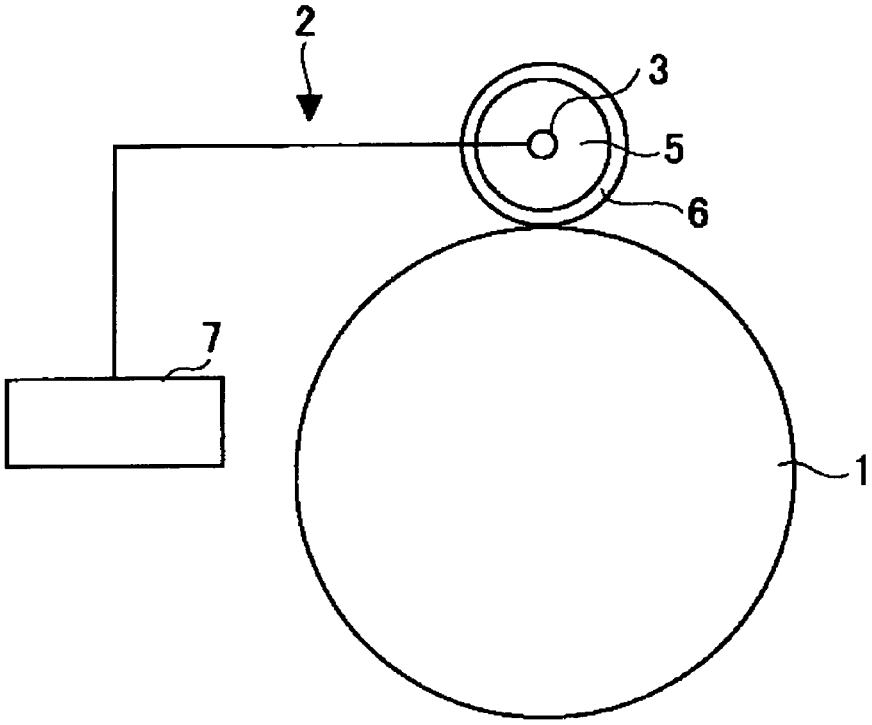
FIG. 1 is a schematic diagram showing an example of a charging unit employed in the image-forming method of the present invention.

The toner of the present invention contains at least a toner base containing a binder resin and colorant, and an inorganic fine particle, and further contains other elements as necessary.

—Inorganic Fine Particles—

The inorganic fine particle includes a compound oxide (also referred to as complex oxide) expressed by the following Composition Formula (1):

$$[M1]_a Si_b O_c \qquad \text{Composition Formula (1)}$$

where "M1" represents a metal element selected from Sr, Mg, Zn, Co, Mn and Ce, "a" and "b" each represents an integer of 1 to 9 and "c" represents an integer of 3 to 9, and further contains other inorganic fine particles as necessary.

An average primary particle diameter of the compound oxide is preferably 0.02 μm to 1.5 μm (20 nm to 1,500 nm), and more preferably 0.05 μm to 1.2 μm (50 nm to 1,200 nm). When the average primary particle diameter is less than 0.02 μm (20 nm), the improvement effect of toner spillage and streaks on the toner bearing member may be decreased. When the average primary particle diameter is more than 1.5 μm (1,500 nm), the adhering force of the compound oxide to the toner becomes weak, which may cause toner spillage and formation of streaks on the toner bearing member, when the image-forming apparatus is operated for a long period of time.

An average secondary particle diameter of the compound oxides is preferably 0.08 μm to 3.5 μm (80 nm to 3,500 nm), more preferably 0.15 μm to 1.7 μm (150 nm to 1,700 nm), and still more preferably 0.25 μm to 1.5 μm (250 nm to 1,500 nm), where the secondary particle is an aggregate of the primary particles. When the average secondary particle diameter is less than 0.08 μm (80 nm), the compound oxide is likely to be buried in the toner base by the friction among toners in the developing unit and between the toner bearing member and the toner layer thickness control member which may reduce the charge amount of the toner, and cause uneven charge property of the surface of the toner base. Thus this may cause the broadening of toner charge distribution and electrostatic aggregation among toners are generated, and then toner spillage and the formation of streaks on the toner bearing member may be facilitated. On the other hand, when the average secondary particle diameter is more than 3.5 μm (3,500 nm), the adhering force of the compound oxide to the toner becomes weak, which may cause toner spillage and formation of streaks on the toner bearing member, when the image-forming apparatus is operated for a long period of time.

The average primary particle diameter of the compound oxide is the average value of the particle diameters, for example, by measuring an equivalent diameter of a picture of transmission electron microscope with magnification 30,000×.

The average secondary particle diameter of the compound oxide is 50% particle size base on the mass standard which is obtained from a volume distribution, for example, measured with Microtrac HRA 9320-X100 manufactured by NIKKISO CO., LTD. and the particle size distribution is measured with the same device, as well.

The compound oxide is externally added to the toner surface by mixing with the toner base by a HENSCHEL MIXER. The externally added compound oxides exist in the surface of the toner base, that is externally added to the toner surface, in the state that dozens of substantially spherical primary particles aggregate to form a secondary particle. This is apparent from the result of the picture of transmission electron microscope in Example 1 shown in FIG. 4.

The Mohs hardness of the compound oxide is preferably 4.5 to 8. When the Mohs hardness is less than 4.5, filming on the image bearing member occurs, and thus the toner is not adequately charged and image deletion may occur. When the Mohs hardness is more than 8, the image bearing member is scraped and scratches are generated thereon. This leads to image defects and the lifetime of the image bearing member may be significantly reduced.

The relative permittivity of the compound oxide measured at 1 MHz AC is preferably 2 to 10 and more preferably 3 to 9 for the purpose of assisting charge property of the toner. When the relative permittivity is less than 2, it does not function as a charge assisting agent and when it is more than 10, it causes charge-ups and the toner may be charged ununiformly in the developing unit.

The relative permittivity of the compound oxide may be measured, for example, by sandwiching a cell for liquid (12964A 5 ml liquid sample holder cell) in which the compound oxide is put between a pair of electrodes by means of an impedance analyzer 1260 (manufactured by Solartron Analytical division of Ametek Inc.) at 1 MHz AC.

The volume resistivity of the compound oxide is $1.0\times10^{11}$ Ω·cm or more and preferably $1.0\times10^{12}$ Ω·cm or more. When the volume resistivity is less than $1.0\times10^{11}$ Ω·cm, the compound oxide attached to the charging member for charging the image bearing member reduces the surface resistance, and causes charge defects of the image bearing member.

The volume resistivity is, for example, measured by sandwiching the compound oxide between a pair of electrodes of a sample box for Digital Ultra-High Resistance Measurement TR42 using Digital Ultra-High Resistance/Micro Current Meters R8340A (manufactured by Advantest Corporation) at 500V DC.

The residual ratio of the compound oxide means that the ratio of the compound oxide still remaining in the toner when energy is applied to a dispersion in which the toner is dispersed by ultrasonic vibration.

The residual ratio of the compound oxide in the toner is preferably 30% to 80%, more preferably 40% to 75%, and still more preferably 50% to 70%. When the residual ratio is less than 30%, the compound oxide easily detach from the toner base, and may be decreased in the toner due to the long time operation of the image-forming apparatus. When the residual ratio is more than 80%, it is not preferred because toner spillage and streaks on the toner bearing member may be occurred because many compound oxide is in the state that is buried in the toner base.

The residual ratio of the compound oxide in the toner is measured by the method disclosed in Japanese Patent (JP-B) Nos. 3186325 and 3129074, wherein the amount of particles as external additive (external particles) remaining on the toner particles is measured as follows:

In a 40-mL triton solution having a concentration of 0.2% (polyoxyethylene octylphenyl ether with a degree of polymerization of 10), 2 g of toner particles is fully dispersed. Then, an ultrasonic vibration apparatus (Ultrasonic Homogenizer US300T, available from NIHONSEIKI KAISHA LTD.) with an ultrasonic vibrator having an oscillating frequency of 20 kHz immersed was operated at an output of 20 W for one minute and at an output of 60 W for 30 minutes, and the external particles were desorbed. Then, the toner particles were centrifuged by a 50-cc centrifuge with a precipitate pipe (small, cooling, high-speed centrifuge, Model M160-IV, available from Sakuma Factory) under a condition 1000 rpm×2 mm. The supernatant solution was removed, and the residue was washed twice with pure water and dried. The dried toner was molded, and the residual external particles were quantitatively determined using an X-ray fluorescence spectrometer (System 3370, available from Rigaku Corporation).

The compound oxide is preferably a magnesium silicate expressed by the following Formula (2):

$$Mg_aSi_bO_c \qquad \text{Formula (2)}$$

where "a" and "b" each represents integer of 1 to 9, and "c" represents a+2b.

Among the magnesium silicate, it is preferably the one selected from a group consisting of forsterite ($Mg_2SiO_4$), steatite ($MgSiO_3$) and enstatite.

The content of the compound oxide in the toner is preferably 0.1 mass % to 5.0 mass %, more preferably 0.2 mass % to 3.0 mass %, and still more preferably 0.3 mass % to 2.5 mass %. When the content of the compound oxide is less than 0.1 mass %, the effect of the present invention may not be brought out. When the content of the compound oxide is more than 5.0 mass %, the charge property of the toner may be significantly reduced, and this may lead to the toner spillage and excess toner convey, toner dust occurrence in the image-forming apparatus.

The content of the magnesium silicate as the compound oxide is, for example, determined from the amount of the Mg element contained in the toner by fluorescent X-ray analysis.

Magnesium silicate is likely to be positively charged due to the effect of MgO part which is likely to be strong positively charged as expressed by the relation of electronegativity (see "Journal of the Imaging Society of Japan" vol. 39, third issue, p. 259).

Examples of the methods for producing the magnesium silicate as the compound oxide include the method disclosed in Japanese Patent Application Laid-Open No. 2003-327470.

The magnesium silicate may be treated with a hydrophobic treatment agent. The hydrophobic treatment agent is not particularly limited and may be appropriately selected according to the purpose. Examples thereof include a silane coupling agent, and a silicone oil.

In the present invention, the other inorganic fine particles other than the compound oxide may be used for the purpose of assisting fluidity, developing property, and charging property of the toner. The primary particle diameter of the inorganic fine particle is preferably 2 nm to 2 μm, and more preferably 5 nm to 500 nm. The specific surface of the inorganic particle by BET method is preferably 20 $m^2/g$ to 500 $m^2/g$. The added amount of the inorganic fine particle is preferably 0.01 mass % to 5.0 mass %, more preferably 0.01 mass % to 2.0 mass % based on the toner base.

The other inorganic fine particles are not particularly limited and may be appropriately selected according to the purpose. Examples thereof include silica, alumina, titanium oxide, barium titanate, magnesium titanate, calcium titanate, strontium titanate, zinc oxide, tin oxide, silica sand, clay, mica, wollastonite, diatom earth, chrome oxide, cerium oxide, colcothar, antimony trioxide, magnesium oxide, zirconium oxide, barium sulfate, barium carbonate, calcium carbonate, silicon carbide and silicon nitride. These may be used singly or in combination.

The compound oxide and other inorganic fine particles are adhered to the surface of the toner base by mixing with the toner base by means of a HENSCHEL MIXER, a super mixer, an Oster blender, or the like. The adhesion property of the compound oxide and other inorganic fine particles to the toner can be adjusted accordingly by the mixing time, the rotation speed of the mixing blade of the mixer and the like.

—Toner Base—

The toner base is not particularly limited, except that the toner base contains at least a binder resin and a colorant, and may be appropriately selected according to the purpose.

The term "toner base" is defined herein as a toner particle and/or toner particles, which do not have any external additives attached onto the surface thereof. In this specification, the toner base is also referred to as a toner base particle and/or toner base particles. Moreover, the term "toner" means a group of toner base particles each having an external additive(s) attached thereon, where the external additive(s) includes the above-mentioned inorganic fine particle.

—Binder Resin—

The binder resin is not particularly limited and may be appropriately selected according to the purpose. Examples of the known binder resins in the field of full-color toners include polyester resins, (meth)acrylic resins, a styrene-(meth)acrylic copolymer resin, epoxy resins, cyclic olefin resins (COC e.g. TOPAS-COC manufactured by Ticona). The polyester resins are preferably used from the viewpoint of stress resistance in a developing unit. These may be used in combination of two or more as necessary.

The polyester resin which is obtained through polycondensation of a polyvalent alcohol component and a polyvalent carboxylic acid component may be used.

Examples of bivalent alcohol component as the polyvalent alcohol component include bisphenol A-alkylene oxide adducts such as polyoxypropylene (2,2)-2,2-bis (4-hydroxyphenyl) propane, polyoxypropylene (3,3)-2,2-bis (4-hydroxyphenyl) propane, polyoxypropylene (6)-2,2-bis (4-hydroxyphenyl) propane and polyoxyethylene (2,0)-2,2-bis (4-hydroxyphenyl) propane; ethylene glycol, diethylene glycol, triethylene glycol, 1,2-propylene glycol, 1,3-propylene glycol, 1,4-butandiol, neopentyl glycol, 1,4-butendiol, 1,5-pentanediol, 1,6 -hexanediol, 1,4-cyclohexanedimethanol, dipropylene glycol, polyethylene glycol, polytetramethylene glycol, bisphenol A and hydrogenated bisphenol A.

Examples of trivalent or more alcohol components include sorbitol, 1,2,3,6-hexanetetrol, 1,4-sorbitan, pentaerythritol, dipentaerythritol, tripentaerythritol, 1,2,4-butantriol, 1,2,5-pentantriol, glycerol, 2-methylprop anetriol, 2-methyl-1,2,4-butantriol, trimethyrolethane, trimethyrolprop ane, and 1,3,5-trihydroxymethylbenzene.

Furthermore, examples of bivalent carboxylic acid component of polyvalent carboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, isooctenyl succinic acid, n-octyl succinic acid, isooctyl succinic acid and anhydrides thereof or lower alkylester.

Examples of trivalent or more carboxylic acid components include 1,2,4-benzenetricarboxylic acid (trimellitic acid), 1,2,5-benzentricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra (methylenecarboxyl) methane, 1,2,7,8-octanetetracarboxylic acid, pyromellitic acid, enpol trimeric acid and anhydrides thereof or lower alkylester.

Furthermore, a resin (hereinafter, referred to as "vinyl polyester resin") obtained by performing condensation polymerization for obtaining polyester resin and radical polymerization for obtaining vinyl resin simultaneously in a same container using a mixture of a basic monomer of polyester resin, basic monomer of vinyl resin and a monomer which reacts with the basic monomers of both resins may be also preferably used as a polyester resin. Meanwhile, a monomer which reacts with basic monomers of both resins is defined as a monomer which can be used for both reactions of condensation polymerization and radical polymerization. In other words, it is a monomer having a carboxyl group which is reactable in condensation polymerization and a vinyl group which is reactable in radical polymerization and examples of such monomer include fumaric acid, maleic acid, acrylic acid and methacrylic acid.

Examples of basic monomers of polyester resin include above-mentioned polyvalent alcohol components and polyvalent carboxylic acid components. Examples of basic monomers of vinyl resin include styrene or styrene derivatives including styrene, o-methylstyrene, m-methylstyrene, p-methylstyrene, α-methylstyrene, p-ethylstyrene, 2,4-dimethylstyrene, p-tert-butylstyrene and p-chlorstyrene; ethylene unsaturated monoolefins including ethylene, propylene, butylene and isobutylene; methacrylic acid alkylesters such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate and dodecyl methacrylate; acrylic acid alkylesters such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate and dodecyl acrylate; and unsaturated carboxylic acids such as acrylic acid, methacrylic acid, itaconic acid and maleic acid; acrylonitrile, maleic acid ester, itaconic acid ester, vinyl chloride, vinyl acetate, benzoic acid vinyl, vinyl methyl ethyl ketone, vinyl hexyl ketone, vinyl methyl ether, vinyl ethyl ether and vinyl isobutyl ether.

Examples of polymerization initiator which is used for initiating polymerization of basic monomers of vinyl resin include azo-based or diazo-based polymerization initiators such as 2,2'-azobis (2,4-dimethylvaleronitrile), 2,2'-azobisisobutylonitrile, 1,1'-azobis (cyclohexane-1-carbonitrile), 2,2'-azobis-4-methoxy-2,4-dimethylvaleronitrile and peroxide-based polymerization initiators such as benzoyl peroxide, dicumyl peroxide, methyl ethyl ketone peroxide, isopropyl peroxycarbonate and lauroyl peroxide.

Various polyester resins as described above are preferably used as binder resins and of these, parallel usage of a first binder resin and a second binder resin is preferable and effective for further improvement of stripping and offset resistance as a toner for oilless fixation.

A polyester resin obtained by condensation polymerization of above-mentioned polyvalent alcohol components and polyvalent carboxylic acid components and in particular, a polyester resin obtained by using bisphenol A-alkylene oxide adduct as a polyvalent alcohol component and terephthalic acid and fumaric acid as polyvalent carboxylic components is used as the first binder resin.

Particularly, a vinyl polyester resin in which bisphenol A-alkylene oxide adduct, terephthalic acid, trimellitic acid and succinic acid are used as basic monomers of the polyester resin, styrene and butylacrylate are used as basic monomers of vinyl resin, and fumaric acid is used as a monomer which is reactable in both reactions, is used as the second binder resin.

It is preferable for a hydrocarbon wax to be internally added during synthesis of the first binder resin. In order to internally add hydrocarbon wax to the first binder resin in advance, the synthesis of the first binder resin is performed while the hydrocarbon wax is added to the monomer for synthesizing the first binder resin. For example, condensation polymerization may be performed while hydrocarbon wax is added to acid monomer and alcohol monomer organizing the polyester resin as the first binder resin. When the first binder resin is a vinyl polyester resin, condensation polymerization and radical polymerization may be performed by allowing basic monomer of vinyl resin to drip while stirring and heating the monomer after hydrocarbon wax is added to the basic monomer of the polyester resin.

—Colorant—

The colorant is not particularly limited and may be appropriately selected from the known colorants. Examples thereof include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, lithopone and a combination thereof.

The content of the colorant in the toner is preferably 0.1 mass % to 15 mass %, more preferably 3 mass % to 10 mass %. When the content of the colorant is less than 0.1 mass %, the coloring strength of the toner may be reduced. When the content of the colorant is more than 15 mass %, a pigment may disperse insufficiently in the toner and this may cause the reduction of the coloring strength and electric property of the toner.

The colorant may be used as a master batch in a composite with a resin as well. Examples of the resins melt-kneaded with producing masterbatch or masterbatch, other than the above binder resins, include a styrene and a polymer of the substitution product thereof such as polystyrene, poly(p-chlorostyrene) and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ketone copolymer, styrene-butadiene copolymer, styrene-isoprene copolymer, and styrene-acrylonitrile-indene copolymer, styrene-maleic acid copolymer, styrene-maleate copolymer; polymethylmethacrylate, polybutylmethacrylate, polyvinyl chloride, polyvinyl acetate, polyethylene, polypropylene, a polyester resin, an epoxy resin, an epoxy polyol resin, a polyurethane resin, a polyamide resin, a polyvinyl butyral resin, a polyacrylic acid resin, rosin, modified rosin, a terpene resin, a aliphatic or alicyclic hydrocarbon resin, an aromatic petroleum resin, chlorinated paraffin and paraffin wax. These may be used singly or in combination.

The toner base may contain a wax to enhance the releasing property between a fixing member and a recording member in a fixing step. Examples of the wax include polyolefin waxes such as polyethylene waxes and polypropylene waxes; long-chain hydrocarbon waxes such as paraffin wax, SASOL wax; carbonyl group-containing waxes.

Examples of the carbonyl group-containing waxes include polyalkanoic acid ester waxes such as carnauba wax, montan wax, trimethylolpropane tribehenate, pentaerythritol tetrabehenate, pentaerythritol diacetate dibehenate, glycerin tribehenate and 1,18-octadecanediol distearate; polyalkanol ester waxes such as tristearyl trimellitate and distearyl maleate; polyalkanoic acid amide waxes such as ethylenediamine dibehenyl amide; polyalkylamide waxes such as trimellitic acid tristearyl amide; and dialkyl ketone waxes such as distearyl ketone.

The melting point of the releasing agent is not particularly limited and may be appropriately selected according to the purpose and it is preferably in the range of 65° C. to 115° C., more preferably 70° C. to 90° C. When the melting point of the releasing agent is less than 65° C., fluidity may be worse, and blocking may be occurred during storage. When it is more than 115° C., releasing property tends to be worse when fixing.

The melting point of the wax can be obtained by determining a maximum peak temperature of the melting heat, for example, by heating up to 200° C. by means of a differential scanning calorimeter (DSC210 by Seiko Instruments Inc.), and then cooling the sample down to 0° C. at the cooling rate of 10° C./min., and subsequently heating at the heating rate of 10° C./min.

The content of the wax is preferably 3 parts by mass to 15 parts by mass, and more preferably 4 parts by mass to 12 parts by mass based on 100 parts by mass of the binder resin. When the content of the wax is less than 3 parts by mass, the wax is exuded on the surface of the fixing member so as not to adhere to the fixing member when fixing, however, as the amount of the wax is little, the releasing effect by the wax is lost, thus the hot-offset margin may be lost. On the other hand, when the content of the wax is more than 15 parts by mass, as the wax is melted at low temperature, the wax is easily suffered from the effect of heat energy and machine energy. When the wax is stirred with a carrier in a developing portion, the wax is removed from the toner surface, and adhered to a toner layer thickness control member and an image bearing member. Then this may cause image noise.

The toner base may further contain a charge controlling agent as necessary. The charge controlling agent is not particularly limited and may be appropriately selected from the known ones according to the purpose. However, a color material may change tone, thus a colorless or color nearly white material is preferable. Examples thereof include triphenylmethane dye, molybdic acid chelate pigment, rhodamine dye, alkoxy amine, quaternized ammonium salt (including fluorine-modified quaternized ammonium salt), alkylamide, simple phosphorus or compound thereof, simple tungsten or compound thereof, fluorine activator, metal salicylate and metal salt of salicylic derivative. These may be used singly or in combination.

For the charge controlling agent, commercially available products may be used. Examples thereof include Bontron P-51 of a quaternary ammonium salt, Bontron E-82 of an oxynaphthoic acid metal complex, Bontron E-84 of a salicylic acid metal complex, and Bontron E-89 of a phenol condensate (produced by Orient Chemical Industries, Ltd.); TP-302 and TP-415, both are a quaternary ammonium salt molybdenum metal complex (produced by Hodogaya Chemical Co.); Copy Charge PSY VP2038, and Copy Charge NEG VP2036 and Copy Charge NX VP434, those are quaternary ammonium salts, Copy Blue PR of a triphenylmethane derivative (produced by Hoechst Ltd.); LRA-901, and LR-147 of a boron metal complex (produced by Japan Carlit Co., Ltd.); quinacridones; azo pigments; and high-molecular mass compounds having sulfonic acid group, carboxylic acid group and a quaternary ammonium salt group.

The content of the charge controlling agent in the toner differ depending on kinds of the binder resins, with or without additives, and dispersing methods, and is preferably 0.1 parts by mass to 10 parts by mass, and more preferably 0.2 parts by mass to 5 parts by mass based on 100 parts by mass of the binder resin.

The other components are not particularly limited and may be appropriately selected according to the purpose. Examples thereof include a flowability improver, a cleaning improver, a magnetic material, and a metal soap.

—Method for Producing Toner—

The method for producing a toner is not particularly limited, and may be appropriately selected from the known methods for producing a toner according to the purpose. Examples thereof include melt-kneading and pulverization, polymerization, dissolution and suspension method, and spray granulation method.

The pulverizing method, for example, is the method in which the toner material containing at least a binder resin and a colorant is melted and mixed, and the obtained kneaded product is crushed and classified to produce the toner base.

The above-noted toner materials are mixed, and the mixture is put in a melting kneader to melt and knead it. For the melting kneader, it is possible to use a uniaxis or two-axis-consecutive kneader, and a batch type kneader using a roll mill. For example, KTK type two-axis extruder manufactured by KOBE STEEL., LTD.; a TEM type two-axis extruder manufactured by TOSHIBA MACHINE CO., LTD.; a two-axis extruder manufactured by KCK; a PCM type two-axis extruder manufactured by IKEGAI, LTD.; and a Co-kneader manufactured by BUSS are preferably used. It is preferred that these melting kneaders be used under appropriate conditions that does not bring separation of molecular chain of the binder resin. Specifically, the melting and kneading temperature is adjusted referring to the softening point of the binder resin. When the melting and kneading temperature is excessively higher than the softening point, molecular chains are bitterly separated, and the melting and kneading temperature may be excessively lower than the softening point, and the dispersion may not proceed.

In the pulverization, a kneaded product obtained in the kneading is pulverized. Specifically, in the pulverization, it is preferable that the obtained kneaded product be coarsely crushed and then finely pulverized. Examples of the pulverizing method include a method in which a kneaded product is made collided with a collision plate in a jet stream, a method in which particles are made collided with each other, and a method in which a kneaded product is pulverized in a gap between a mechanically rotating roller and a stirrer.

The pulverized product obtained in the pulverization is classified and controlled to particles having predetermined particle diameters. The classification of particles can be performed by removing fine particles using, for example, a cyclone, a decanter, a centrifugal separator, or the like.

When the pulverization and classification of particles are completed, the pulverized product was classified in an airflow using centrifugal force to produce a toner base having predetermined particle diameters.

Subsequently, an external additive is added to the toner base. The toner base and the external additive are mixed and stirred using mixer, and then the external additive is coated to the toner base surface during pulverizing. At this time, it is important that the external additives such as the inorganic particles and the resin fine particles are uniformly and strongly adhered to the toner base in terms of durability.

An example of the method for producing the toner by polymerization is as follows: toner materials containing at least a modified polyester resin which may be able to form urea bonding or urethane bonding and a colorant are dissolved and/or dispersed in an organic solvent. Then, the dissolved and/or dispersed solution is dispersed in an aqueous medium and subjected to polyaddition reaction. The solvent of this dispersion is removed, and the residue is washed, to thereby obtain the toner base.

Examples of the modified polyester resin which may be able to form urea bonding or urethane bonding include a polyester prepolymer having an isocyanate group, which is resulted from a carboxylic acid group and a hydrogen group in the polyester end is reacted with a polyisocyanate compound (PIC). The modified polyester resin is obtained through cross-linking and/or elongation reaction of molecular chains by the reaction between a polyester prepolymer having an isocyanate group and amines. The modified polyester resin can make the hot-offset property better with keeping the low-temperature fixing property.

Examples of the polyisocyanate (PIC) include an aliphatic polyisocyanate such as tetramethylene diisocyanate, hexamethylene diisocyanate, and 2,6-diisocyanato methyl caproate; an alicyclic polyisocyanate such as isophorone diisocyanate, and cyclohexyl methane diisocyanate; an aromatic diisocyanate such as tolylene diisocyanate and diphenylmethane diisocyanate; an aromatic-aliphatic diisocyanate such as $\alpha,\alpha,\alpha',\alpha'$-tetramethylxylene diisocyanate; an isocyanurate; the polyisocyanate blocked by phenol derivative, oxime and caprolactam. These may be used singly or in combination.

The ratio of the polyisocyanate (PIC) is, defined as an equivalent ratio [NCO]/[OH] of an isocyanate [NCO] to a hydroxyl group [OH] of the polyester having a hydroxyl group, preferably 5/1 to 1/1, more preferably 4/1 to 1.2/1, and still more preferably 2.5/1 to 1.5/1.

The number of isocyanate group included in one molecule of polyester prepolymer having an isocyanate group (A) is usually one or more, preferably 1.5 to 3 on average, and more preferably 1.8 to 2.5 on average.

Examples of the amines (B) to be reacted with a polyester prepolymer (A) include a diamine compound (B1), a polyamine compound with three or more valences (B2), an amino alcohol (B3), an amino mercaptan (B4), an amino acid (B5) and a component in which an amino group of B1 to B5 is blocked (B6).

The diamine compound (B1) include an aromatic diamine such as phenylene diamine, diethyltoluene diamine, and 4,4'-diaminodiphenylmethane; an alicyclic diamine such as 4,4'-diamino- 3,3'-dimethyldicyclohexylmethane, diamine cyclohexane and isophorone diamine; and an aliphatic diamine such as ethylene diamine, tetramethylene diamine and hexamethylene diamine.

Examples of the polyamine compounds with three or more valences (B2) include diethylenetriamine and triethylenetetramine.

Examples of the amino alcohol (B3) include ethanolamine and hydroxyethylaniline.

Examples of the amino mercaptan (B4) include an aminomethyl mercaptan and aminopropyl mercaptan.

Examples of the amino acid (B5) include aminopropionic acid and aminocaproic acid.

Examples of the component in which an amino group of B1 to B5 is blocked (B6) include a ketimine compound obtained from the amines B1 to B5 and ketones such as acetone, methyl ethyl ketone and methyl isobutyl ketone; and an oxazolidine compound. Among these amines (B), B1 and a mixture of B1 with a small amount of B2 are preferable.

The ratio of the amines (B) is, defined as an equivalent ratio $[NCO]/[NH_x]$ of an isocyanate [NCO] in the polyester prepolymer having an isocyanate group (A) to an amino group $[NH_x]$ in the amines (B), preferably 1/2 to 2/1, more preferably 1.5/1 to 1/1.5, and still more preferably 1.2/1 to 1/1.2.

With the method for producing the toner by the above polymerization, a spherical shaped toner having a small particle diameter can prepared at a low-cost with less environmental impact.

The volume-average particle diameter of the toner is preferably 3 μm to 12 μm, more preferably 4 μm to 9 μm. When the volume-average particle diameter of the toner is less than 3 μm, it is inappropriate hygienically as inhale of the toner dust affects a human body. When the volume-average particle diameter of the toner is more than 12 μm, the reproducibility of high-resolution printing may become worse.

The volume average particle diameter of the toner can be measured by a Coulter counter method. Specific example of measuring equipments include Coulter counter TA-II, Coulter multisizer II and Coulter multisizer III (manufactured by Beckman Coulter, Inc.).

The toner is preferably used as a nonmagnetic one-component developer for a nonmagnetic one-component developing.

(Image-Forming Method and Image-Forming Apparatus)

An image-forming apparatus of the present invention contains at least an image bearing member, a charging unit which is disposed so as to contact with the image bearing member, and configured to charge the surface of the image bearing member at a predetermined potential, an exposing unit which is configured to expose the charged surface of the image bearing member to form a latent electrostatic image, a developing unit which is configured to develop the latent electrostatic image using a toner to form a visible image, a transferring unit which is configured to transfer the visible image to a recording medium, and further contains additional units as needed.

The toner of the present invention is used as the toner.

An image-forming method of the present invention contains at least charging a surface of an image bearing member, exposing the charged surface of the image bearing member to form a latent electrostatic image, developing the latent electrostatic image using a toner to form a visible image, transferring the visible image to a recording medium, and fixing the transferred image on the recording medium, and further contains other steps as necessary.

The toner of the present invention is used as the toner.

—Image Bearing Member—

Materials, shapes, structures or sizes, etc. of the image bearing member (also referred to as "photoconductor") are not particularly limited and may be appropriately selected from known image bearing members accordingly. Examples of the shape thereof include a drum-shape, a sheet-shape, and an endless belt-shape. The structures thereof may be a single layer structure or multilayer structure. The size thereof may be appropriately selected depending on the size and specification of the image-forming apparatus. The materials thereof are, for example, inorganic photoconductors such as amorphous silicon, selenium, CdS, ZnO; organic photoconductors (OPC) such as polysilane, phthalopolymethine, and the like.

The amorphous silicon photoconductor is formed, for example, by heating a substrate at 50° C. to 400° C., and forming a photoconductive layer on the substrate by depositing a-Si in accordance with a film formation method such as a vapor deposition method, a sputtering method, an ion plating method, a thermal-CVD method, a photo-CVD method, and a plasma-CVD method. Among these methods, the plasma-CVD method is preferable, where an a-Si deposition layer is formed on a substrate by decomposing a source gas with DC, or high-frequency or microwave glow discharge.

The organic photoconductor (OPC) is commonly used as the image-bearing member because of the following reasons: (1) optical properties thereof, such as wide wavelength band of optical absorption and large amount of light absorption; (2) electric properties thereof, such as high-sensitive and stable charge property; (3) wide selection of material; (4) easy production; (5) low cost; and (6) nontoxicity. The layer structure of the organic photoconductor is classified broadly into a single-layered structure, and a laminated structure.

The photoconductor having the single-layered structure contains a support, a single-layered photosensitive layer on the support, and further contains a protective layer, an intermediate layer and other layers as necessary.

The photoconductor having the laminated structure contains a support, a laminated photosensitive layer having at least a charge generating layer, and a charge transport layer in this order, and further contains a protective layer, an intermediate layer and other layers as necessary.

—Charging Step and Charging Unit—

The charging is the step of charging uniformly the surface of the image bearing member and may be performed with the charging unit.

The charging unit is not particularly limited as long as it can charge the surface of the image bearing member uniformly by applying a voltage, and may be appropriately selected according to the purpose. There are two types of the charging unit: (1) a contact charging unit configured to contact with the image bearing member so as to charge it; (2) a noncontact charging unit configured to charge the image bearing member without contacting.

Examples of (1) the contact charging unit include a conductive or semiconductive charging roller, a magnetic brush, a fur brush, a film and a rubber blade. Among these, the charging roller can significantly reduce the amount of ozone generation compared with a corona discharge, and is excellent in stability at the time the image bearing member is repeatedly used. Thus it is effective to prevent image deterioration.

Examples of (2) the noncontact charging unit include a noncontact charging unit utilizing corona discharge, a needle electrode device, a solid discharge device, a conductive or semiconductive charging roller which is disposed with a minute space from the image bearing member.

—Exposing Step and Exposing Unit—

The exposing is the step of imagewise exposing the surface of the image bearing member with the exposing unit.

The optical system applied for the exposing is classified broadly in an analogue optical system and a digital optical system. The analogue optical system is an optical system in which an original copy is directly projected on the image bearing member with the optical system, and the digital optical system is an optical system in which an image information is given as an electric signal and it is converted into a light signal to expose the image bearing member to form an image.

The exposing unit is not particularly limited as long as it can expose the surface of the image bearing member charged by the charging unit imagewise as intended, and may be appropriately selected according to the purpose. Examples of the exposing unit include a copying optical system, a rod lens array system, a laser optical system, a liquid crystal shutter and an LED optical system.

—Developing Step and Developing Unit—

The developing is the step of developing the latent electrostatic image using the toner to form a visible image.

The formation of the visible image can be performed by developing the latent electrostatic image using the toner and it can be performed by the developing unit.

The developing unit contains a rotatable toner conveying member (a developing roller or toner bearing member) and a toner supplying member (a toner supplying roller) which supplies a toner to the toner conveying member, and further contains a toner layer thickness control member.

Next, an example of the construction of the developing unit which can be applied to the present invention will be illustrated hereinafter.

A roller coated with an elastic rubber layer is used as a developing roller, and a surface coat layer made of a material which is likely to be charged opposite to that of the toner is disposed on the surface of the developing roller. The elastic rubber layer is designed to have a hardness JIS-A of 60 degrees or less in accordance with the standard specified in JIS-K 6301-1975 in order to prevent toner degradation caused by pressure concentration at a contact portion with the toner layer thickness control member. The surface roughness of the developing roller is set at Ra of 0.31 μm to 2.0 μm so that the required amount of toner can be retained on the surface thereof. Moreover, since developing bias is applied to the developing roller to form an electrical field with the image bearing member, the resistance value of the elastic rubber layer is set at $10^3$ Ω to $10^{10}$ Ω.

The developing roller rotates in a clockwise direction and transfer the toner retained on the surface thereof to a position facing the toner layer thickness control member and the image bearing member.

The toner layer thickness control member is disposed below the contact position of the toner supplying roller and the developing roller. The toner layer thickness control member is formed of a metallic plate spring material, such as SUS and phosphor bronze, and a free end of the toner layer thickness control member is brought into contact with the surface of the developing roller at a suppress strength of 10 N/m to 40 N/m. The toner passed through the suppressed spot of the toner layer thickness control member is made in the form of thin layer and at the same time, is charged by frictional charging. Moreover, a control bias of the value which is offset in the same direction of the charge polarity of the toner corresponding to developing bias is applied to the toner layer thickness control member to assist frictional charging.

The material consisting of the elastic rubber layer of the developing roller is not particularly limited, and may be appropriately selected according to the purpose. Examples thereof include styrene-butadiene copolymer rubber, acrylonitrile-butadiene copolymer rubber, acrylic rubber, epichlorohydrin rubber, urethane rubber, and silicone rubber. These may be used singly or in combination. Among these, a blend rubber of epichlorohydrin rubber and acrylonitrile-butadiene copolymer rubber is preferably used.

The developing roller is, for example, manufactured by coating a periphery of conductive shaft with the above-mentioned elastic rubber material. The conductive shaft is, for example, composed of metals such as stainless.

The charging member has shaft 3, conductive layer 5 disposed on shaft 3 and surface layer 6 which covers conductive layer 5 as shown in FIG. 1 and is formed in a cylindrical form. The voltage applied to shaft 3 by voltage source 7 is applied to image bearing member 1 through conductive layer 5 and surface layer 6 to charge the surface of image bearing member 1.

Shaft 3 of charging member 2 is positioned along the longitudinal direction of image bearing member 1 (in parallel with the axis of image bearing member 1) and charging member 2 is entirely pressed against image bearing member 1 with the predefined suppress strength. Thereby a portion of the surface of image bearing member 1 and a portion of the surface of charging member 2 are brought into contact with each other along each longitudinal direction to form a contact nip with a predetermined width. Image bearing member 1 is rotary activated by an activating unit not shown in figures and the charging member 2 is constructed so as to rotate along with image bearing member 1.

In FIG. 1, an exposing unit, a developing unit, a transferring unit and a cleaning unit are omitted.

The charging of image bearing member 1 by voltage source 7 is performed at the vicinity of the above contact nip. The surface of the charging member 2 and the charged region (corresponds to the length of charging member 2) of the surface of image bearing member 1 are brought into evenly contact with each other at the contact nip to thereby make the charged region of the surface of image bearing member 1 uniformly charged.

The conductive layer 5 of the charging member 2 is formed of a nonmetal (in this case, a conductive vulcanized rubber), and a material of low hardness can be preferably used in order to stabilize the contact state with image bearing member 1. Examples thereof include resins such as polyurethane, polyether and polyvinyl alcohol and rubbers such as hydrin rubber, EPDM and NBR. Examples of conductive materials include carbon black, graphite, titanic oxide and zinc oxide.

The materials having a moderate resistance value ($10^2$ Ω to $10^{10}$ Ω) such as polyurethane-silicone acrylic polymer containing acetylene black are used for surface layer 6.

Examples of resins include nylon, polyamide, polyimide, polyurethane, polyester, silicone, Tefron™, polyacetylene, polypyrrole, polythiophene, polycarbonate and polyvinyl, and fluorine resins are preferably used for improving a water contact angle.

Examples of fluorine resins include polyvinylidene-fluoride, polyethylene-fluoride, vinylidene fluoride-tetrafluoroethylene copolymer and vinylidene fluoride-tetrafluoroethylene-propylene hexafluoride copolymer.

Furthermore, conductive materials such as carbon black, graphite, titanic oxide, zinc oxide, tin oxide and iron oxide may be appropriately added on a surface layer for the purpose of adjusting the resistance to moderate value.

Figure 2:
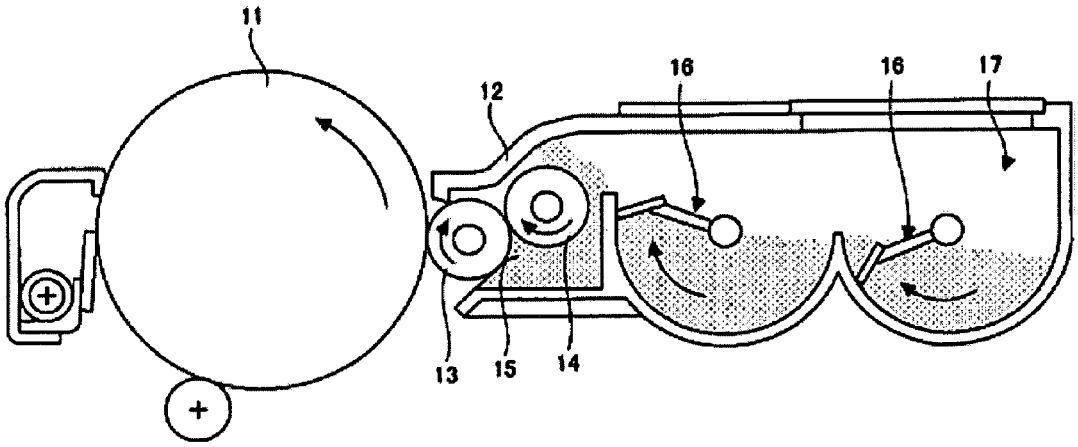
FIG. 2 is a schematic diagram showing an example of an image-forming apparatus of the present invention.

An exemplary image-forming method of the present invention is shown in FIG. 2. In this image-forming method, image bearing member 11 is rotated from downward to upward in an arrow direction. As a toner conveying member, developing roller (toner bearing member) 13 of development device 12 is activated as shown by the arrow while being in contact with image bearing member 11 or retaining a gap of approximately 0.1 μm to 0.3 μm from image bearing member 11.

The developing roller 13 is composed of metal conductive body such as aluminum and stainless of which appropriate roughness of the surface is retained by sandblast treatment. Around developing roller 13, toner supplying roller 14 as a toner supplying member and control blade (toner layer thickness control blade) 15, which is made from a rubber plate such as urethane rubber or silicone rubber attached to the blade spring material, or of a metal such as SUS, are disposed.

Furthermore, toner feeding shaft 16 is disposed in retention room 17 in which a toner is rotatably retained for feeding the toner to toner supplying roller 14.

—Transferring Step and Transferring Unit—

The transferring is a step of transferring the visible image to a recording medium. The transferring step preferably has an aspect that with an intermediate transferring member, it performs a primary transfer to transfer the visible image to the intermediate transferring member followed by a secondary transfer to transfer the visible image to the recording medium. A more preferable aspect includes a primary transferring step that transfers the visible image to the intermediate transferring unit to form a complex transfer image and a secondary transferring step that transfers the complex transfer image to the recording medium using a toner having two or more colors or preferably a full-color toner.

The transferring may be performed by charging the image bearing member using a transfer charging unit, and may be performed by the transferring unit. The transferring unit preferably has an aspect that includes a primary transferring unit that transfers a visible image to an intermediate transferring member to form a complex transfer image and a secondary transferring unit that transfers the complex transfer image to a recording medium.

The intermediate transferring member is not particularly limited and may be appropriately selected according to the purpose from the known transferring member. Examples thereof include a transfer belt.

The transferring unit, i.e. the primary transferring unit and the secondary transferring unit, preferably contains at least a transferring unit that separates and charges the visible image formed on the image bearing member to the side of the recording medium. There may be one transferring unit, or two or more.

Examples of the transferring units include a corona transferring unit by corona discharge, a transfer belt, a transfer roller, a pressure transfer roller and an adhesive transferring unit.

The recording medium is not particularly limited and may be appropriately selected from the known recording mediums (recording sheets).

The fixing is the step of fixing the visible image transferred to the recording medium by means of a fixing unit. It may be performed every time the toner of each color is transferred to the recording medium, or it may be performed at once when the toner of all the colors is laminated.

The fixing unit is not particularly limited and may be appropriately selected according to the purpose. The known hot-pressing means is preferable. Examples of the hot-pressing units include a combination of a heat roller and a pressure roller and a combination of a heat roller, a pressure roller and an endless belt.

In general, the heating in the hot-pressing unit is preferably 80° C. to 200° C.

In the present invention, the known optical fixing unit, for example, may be used along with or in place of the fixing step and the fixing unit according to the purpose.

The discharging is the step of discharging the image bearing member by applying a discharging bias, and it may be preferably performed by a discharging unit.

The discharging unit is not particularly limited as long as the discharging bias is applied to the image bearing member, and may be appropriately selected from the known discharging units. Examples thereof include a discharge lamp.

The cleaning is the step of removing the residual toner on the image bearing member, and may be preferably performed by a cleaning unit.

The cleaning unit is not particularly limited as long as it can remove the toner remaining on the image bearing member, and may be appropriately selected from the known cleaners. Examples thereof include a magnetic brush cleaner, a static brush cleaner, a magnetic roller cleaner, a blade cleaner, a brush cleaner and a web cleaner.

The recycling is the step of recycling the toner removed in the cleaning step to the developing step, and may be preferably performed by a recycling unit.

The recycling unit is not particularly limited, and the known transporting units may be used.

The controlling is the step of controlling each of the above-mentioned steps, and may be preferably performed by a controlling unit.

The controlling unit is not particularly limited as long as it can control the behavior of each of the units. Examples thereof include equipments such as sequencer and computer.

(Process Cartridge)

Moreover, the present invention may be constructed as a process cartridge detachably attached to the image-forming apparatus using the image-forming method.

A process cartridge of the invention contains at least an image bearing member, a charging unit which is disposed so as to contact with the image bearing member, and configured to charge the surface of the image bearing member at a predetermined potential, a developing unit configured to develop the latent electrostatic image using a toner to form a visible image, wherein the developing unit containing a rotatable toner conveying member and a toner supplying member which supplies a toner to the toner conveying member, and the process cartridge is detachably attached to an image-forming apparatus, and the toner is the toner of the present invention. The process cartridge further contains a transferring unit, a cleaning unit, and a discharging unit.

Figure 3:
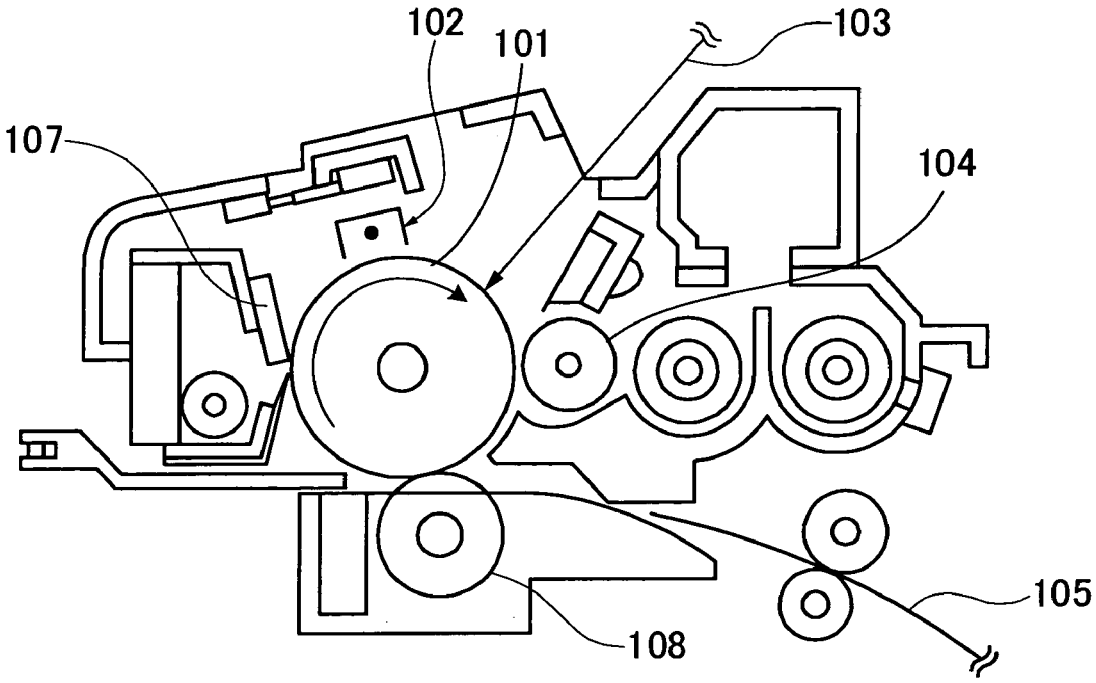
FIG. 3 is a schematic diagram showing an example of a process cartridge of the present invention.

The process cartridge, for example as shown in FIG. 3, houses image bearing member 101, charging unit 102, developing unit 104, transferring unit 108, and cleaning unit 107, and further contains other units as necessary. In FIG. 3, 103 and 105 are respectively exposure light from an exposure unit, and a recording medium.

Next, the image-forming step by the process cartridge shown in FIG. 3 will be illustrated. The latent electrostatic image corresponding to the exposed image is formed on the surface of image bearing member 101 which is rotated in the arrow direction by charging with charging unit 102 and exposing 103 with the exposing unit (not shown). The latent electrostatic image is developed by means of developing unit 104, then the obtained visible image is transferred to recording medium 105 by means of transferring unit 108 and printed out. And the surface of the image bearing member after transferring the image is cleaned by means of cleaning unit 107 and further discharged by means of discharging unit (not shown) and these operations are again repeated.

The image-forming apparatus, image-forming method and process cartridge of the present invention using the toner of the present invention can provide an image quality which is not impaired in spite of use for a long period of time, a high image quality and a stable image formation which can be maintained.

EXAMPLES

Hereinafter, with referring to Examples, the invention is explained in detail and the following Examples should not be construed as limiting the scope of this invention. In Examples and Comparative Examples, all part(s) and percentage (%) are expressed by mass-basis unless indicated otherwise, and "Volume Average Particle Diameter of Toner" and "Softening Point of Resin" are measured as follows:

<Volume Average Particle Diameter of Toner>

The volume average particle diameter of the toner was measured by a Coulter counter method. As a measuring equipment, Coulter counter TA-II (manufactured by Beckman Coulter, Inc.) was used.

First, 0.1 ml to 5 ml of a surfactant (preferably alkylbenzene sulfonate) was added to 100 ml to 150 ml of electrolytic solution as a dispersant. The electrolytic solution was a 1 mass % aqueous solution of NaCl prepared using primary sodium chloride (ISOTON-IL manufactured by Beckman Coulter, Inc). 2 mg to 20 mg of the measurement sample was further added in terms of a solid content. The electrolytic solution in which the sample was suspended was subject to dispersion treatment for approximately 1 minute to 3 minutes using an ultrasonic disperser and the volume and number of the toner were measured by means of the measuring equipment, employing an aperture of 100 μm to calculate volume and number distributions. The volume average particle diameter (Dv) and number average particle diameter (Dp) could be obtained from the obtained distributions.

As channels, 13 channels were used: 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; 32.00 μm to less than 40.30 μm. The particles having a particle diameter of 2.00 μm to less than 40.30 μm were surveyed.

<Softening Point (Tm) of Resin>

1.5 g of measurement sample was weighed and subjected to a measurement of a softening point, using a flow tester (CFT-500 manufactured by Shimadzu Corporation) and a die of 1.0 mm height and 1.0 mm diameter in a condition of temperature rise rate of 3.0° C./min., pre-heating time of 180 seconds, loading of 30 kg and a measuring temperature range of 80° C. to 140° C. The temperature at which a half of the above sample was discharged was set to be as a softening point.

Preparation Example 1

—Preparation of Forsterite A—

A slurry of $Mg(OH)_2$ powder, and $SiO_2$ powder (average primary particle diameter of 0.02 μm) were weighed so that the molar ratio of $MgO:SiO_2$ became 2:1, and a slurry of 150 L with a MgO concentration of 71.5 g/L and an $SiO_2$ concentration of 53.3 g/L was prepared. A wet pulverization was performed on the thus prepared slurry by means of a sand grinder mill in the condition of media filling ratio of 80%, a solution feeding rate of 3.8 L/min and the slurry passing through a filtering part of 3 times, using zirconia beads having a diameter of 0.8 mm as a media. The slurry was then spray dried using a spray drier, and baked under the atmosphere at 1,100° C. for 30 minutes in an electric furnace. The baked product was then made into a slurry having a concentration of 300 g/L, and 50 L of the slurry was subjected to wet pulverization by means of a sand grinder mill in the condition of media filling ratio of 80%, a solution feeding rate of 5.6 L/min and the slurry passing through a filtering part of 2 times, using zirconia beads having a diameter of 0.8 mm as a media. The obtained slurry was then spray dried using a spray drier and was subjected to pulverization by means of a sand mill to obtain forsterite A.

Preparation Example 2

—Preparation of Forsterite B—

Forsterite B was prepared in the same manner as in Preparation Example 1, except that the condition was changed to the slurry passing through the filtering part of 2 times in the first wet pulverization, and the solution feeding rate of 5.2 L/min and the slurry passing through the filtering part of 4 times in the wet pulverization performed on the baked product in Preparation Example 1.

Preparation Example 3

—Preparation of Forsterite C—

Forsterite C was prepared in the same manner as in Preparation Example 1, except that the condition was changed to the solution feeding rate of 4.5 L/min and the slurry passing through the filtering part of 1 time in the first wet pulverization, and the solution feeding rate of 5.7 L/min, the slurry passing through the filtering part of 5 times, and the zirconia beads having a diameter of 1.0-mm as a media in the wet pulverization performed on the baked product in Preparation Example 1.

Preparation Example 4

—Preparation of Forsterite D—

Forsterite D was prepared in the same manner as in Preparation Example 1, except that the condition was changed to that the first wet pulverization was not performed, and the slurry passing through the filtering part of 1 time, and the zirconia beads having a diameter of 1.0 mm as a media in the wet pulverization performed on the baked product in Preparation Example 1.

Preparation Example 5

—Preparation of Enstatite A—

Enstatite A was prepared in the same manner as in Preparation Example 1, except that the condition was changed to that the slurry of $Mg(OH)_2$ powder, and $SiO_2$ powder were weighed so that the molar ratio of $MgO:SiO_2$ became 1:1, and the slurry of 150 L with a MgO concentration of 35.8 g/L and an $SiO_2$ concentration of 53.3 g/L was prepared, and the solution feeding rate of 4.0 L/min in the first wet pulverization in Preparation Example 1.

The obtained forsterites A to D, and enstatite A were subjected to the measurements of the characteristics as follows. The results are shown in Table 1.

<Method for Measuring the Particle Diameter of the Compound Oxide>

The average primary particle diameter of the magnesium silicate as the compound oxide was obtained as the average value of the particle diameter by measuring an equivalent diameter of a picture of transmission electron microscope with magnification 30,000×. The average secondary particle diameter of the magnesium silicate as the compound oxide was obtained as 50% of mass-based particle size which was obtained from a volume distribution measured with Microtrac HRA 9320-X100 manufactured by NIKKISO CO., LTD. and the particle size distribution was measured with the same device, as well.

<Measuring Relative Permittivity>

The relative permittivity was measured by sandwiching a cell for liquid (12964A type, 5 ml liquid sample holder cell) in which 1 g of the magnesium silicate was put between a pair of electrodes by means of an impedance analyzer 1260 (manufactured by Solartron Analytical division of Ametek Inc.) at 1 MHz AC.

<Measuring Volume Resistivity>

The volume resistivity was measured by sandwiching 3 g of the magnesium silicate between a pair of electrodes of a sample box for Digital Ultra-High Resistance Measurement TR42 using Digital Ultra-High Resistance/Micro Current Meters R8340A (manufactured by Advantest Corporation) at 500V DC.

<Measuring Mohs Hardness>

The pellets for the magnesium silicate were prepared and the surface was scratched with standard material as shown in Table 2 which determined Mohs hardness and the hardness was measured by presence or absence of the scratches. The Mohs hardness chart is shown in Table 2. The ones fall in between are expressed by a half of the value.

TABLE 1

| | average secondary particle diameter (μm) | average primary particle diameter (μm) | Mohs hardness | volume resistivity (Ω · cm) | relative permittivity |
|---|---|---|---|---|---|
| forsterite A | 0.39 | 0.08 | 7 | $2.0 \times 10^{14}$ | 6.0 |
| forsterite B | 1.03 | 0.36 | 7 | $2.1 \times 10^{14}$ | 6.0 |
| forsterite C | 1.21 | 1.04 | 7 | $2.2 \times 10^{14}$ | 5.8 |
| forsterite D | 3.61 | 1.66 | 7 | $2.4 \times 10^{14}$ | 5.5 |
| enstatite A | 0.40 | 0.09 | 7 | $3.0 \times 10^{14}$ | 6.1 |
| strontium titanate A | 0.35 | 0.08 | 6 | $1.3 \times 10^{11}$ | 300 |

TABLE 2

| Hardness No. | Type | Chemical Composition |
|---|---|---|
| 1 | Talc | $Mg_3(Si_4O_{10})(OH)_2$ |
| 2 | gypsum | $CaSO_4 2H_2O$ |
| 3 | calcite | $CaCO_3$ |
| 4 | fluorite | $CaF_2$ |
| 5 | apatite | $Ca_5F(PO_4)_3$ |
| 6 | orthoclaes | $K(AlSiO_8)$ |
| 7 | quartz | $SiO_2$ |
| 8 | topaz | $Al_2(F,OH)_2(SiO_4)$ |
| 9 | corundum | $Al_2O_3$ |
| 10 | diamond | C |

Example 1

—Preparation of Toner 1—

Polyester resin A (softening point of 131° C., acid value (AV) of 25 mgKOH/g) . . . 68 parts Polyester resin B (softening point of 116° C., acid value (AV) of 1.9 mgKOH/g) . . . 32 parts an masterbatch (containing 50 mass % of C.I. Pigment Blue 15:3) . . . 8 parts Carnauba wax . . . 4 parts After the above toner materials were mixed adequately using a HENSCHEL MIXER, it was then melt-kneaded using a two-axis extrusion kneader (PCM-30 manufactured by Ikegai Ltd.) of which an outlet portion was removed and the obtained product was rolled into a thickness of 2 mm using a cooling press roller and it was roughly pulverized by a feather mill after cooling on a cooling belt. It was then pulverized to have a volume average particle diameter of 10 μm to 12 μm using a mechanical pulverizer (KTM manufactured by Kawasaki Heavy Industries, Ltd.) and further pulverized while being subjected to coarse classification using a jet pulverizer (IDS manufactured by Nippon Pneumatic Mfg. Co., Ltd.) and fine classification using a rotor classifier (T Plex classifier, 100ATP manufactured by Hosokawa Micron Corporation) to obtain a toner base A. The volume average particle diameter of the toner base A was 7.9 μm.

0.8 parts by mass of forsterite A (average secondary particle diameter of 0.39 μm, average primary particle diameter of 80 nm) and 1 part by mass of Silica RX200 (by Nippon Aerosil Co., Ltd.) were added to 100 parts by mass of the toner base A and mixed by means of a HENSCHEL MIXER at a peripheral velocity of 40 m/sec. for 5 minutes to obtain Toner 1.

Figure 4:
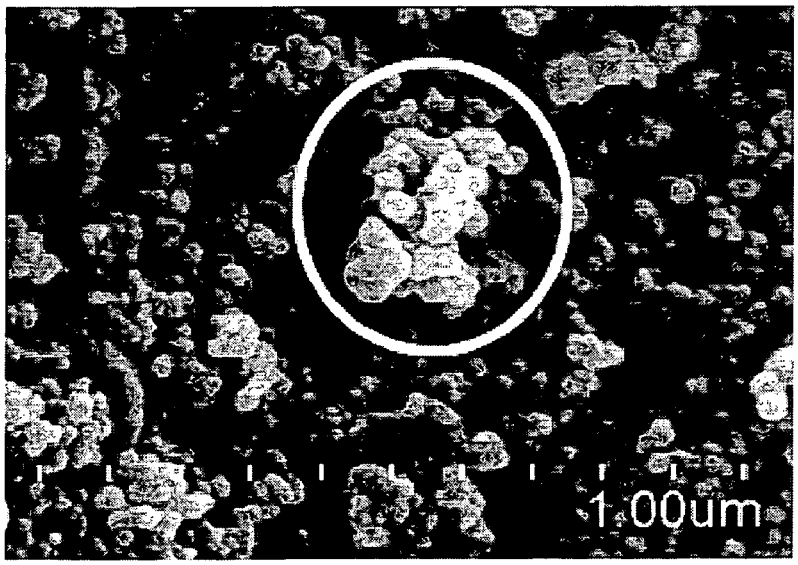
FIG. 4 is a picture of transmission electron microscope showing a toner surface in which the particles of compound oxide were used as an external additive in Example 1.

The picture of transmission electron microscope showing the surface of the obtained Toner 1 is shown in FIG. 4. It could be ascertained that dozens of substantially spherical primary particles (several dozen nm to hundred and several tens nm) of forsterite A aggregate to form a secondary particle (several hundred nm) of forsterite A in the surface of the toner base from the circled part in FIG. 4.

Example 2

—Preparation of Toner 2—

Polyester/styrene-acrylic hybrid resin containing wax therein (containing 6.6 mass % of paraffin wax, softening point of 130° C., acid value (AV) of 24 mgKOH/g) . . . 70 parts Polyester resin C (softening point of 115° C., acid value (AV) of 1.8 mgKOH/g) . . . 30 parts Cyan masterbatch (containing 50 mass % of C.I. Pigment Blue 15:3) . . . 8 parts After the above toner materials were mixed adequately using a HENSCHEL MIXER, it was then melt-kneaded using a two-axis extrusion kneader (PCM-30 manufactured by Ikegai Ltd.) of which an outlet portion was removed and the obtained product was rolled into a thickness of 2 mm using a cooling press roller and it was roughly pulverized by a feather mill after cooling on a cooling belt. It was then pulverized to have a volume average particle diameter of 10 μm to 12 μm using a mechanical pulverizer (KTM manufactured by Kawasaki Heavy Industries, Ltd.) and further pulverized while being subjected to coarse classification using a jet pulverizer (IDS manufactured by Nippon Pneumatic Mfg. Co., Ltd.) and fine classification using a rotor classifier (T Plex classifier, 100ATP manufactured by Hosokawa Micron Corporation) to obtain a toner base B. The volume average particle diameter of the toner base B was 8.1 μm.

1.1 parts by mass of forsterite A (average secondary particle diameter of 0.39 μm, average primary particle diameter of 80nm) and 1 part by mass of Silica RX200 (by Nippon Aerosil Co., Ltd.) were added to 100 parts by mass of the toner base B and mixed by means of a HENSCHEL MIXER at a peripheral velocity of 40 m/sec. for 5 minutes to obtain Toner 2.

Example 3

—Preparation of Toner 3—

Toner 3 was prepared in the same manner as in Example 1, except that 1.5 parts by mass of forsterite A (average secondary particle diameter of 0.39 μm, average primary particle diameter of 80 nm) and 1.1 parts by mass of Silica RX200 (by Nippon Aerosil Co., Ltd.) were added to 100 parts by mass of the toner base A and mixed by means of a HENSCHEL MIXER at a peripheral velocity of 40 m/sec. for 6 minutes in Example 1.

Example 4

—Preparation of Toner 4—

Toner 4 was prepared in the same manner as in Example 2, except that 1.5 parts by mass of forsterite B (average secondary particle diameter of 1.03 μm, average primary particle diameter of 0.36 μm) and 1.0 part by mass of Silica RX200 (by Nippon Aerosil Co., Ltd.) were added to 100 parts by mass of the toner base B and mixed by means of a HENSCHEL MIXER at a peripheral velocity of 40 m/sec. for 7 minutes in Example 2.

Example 5

—Preparation of Toner 5—

Toner 5 was in the same manner as in Example 1, except that 1.2 parts by mass of forsterite C (average secondary particle diameter of 1.21 μm, average primary particle diameter of 1.04 μm) and 1.5 parts by mass of Silica RX200 (by Nippon Aerosil Co., Ltd.) were added to 100 parts by mass of the toner base A and mixed by means of a HENSCHEL MIXER at a peripheral velocity of 40 m/sec. for 8 minutes in Example 1.

Example 6

—Preparation of Toner 6—

Toner 6 was in the same manner as in Example 1, except that 0.8 parts by mass of enstatite A (average secondary particle diameter of 0.40 μm, average primary particle diameter of 0.09 μm) and 1.0 parts by mass of Silica RX200 (by Nippon Aerosil Co., Ltd.) were added to 100 parts by mass of the toner base A and mixed by means of a HENSCHEL MIXER at the peripheral velocity of 40 m/sec. for 5 minutes in Example 1.

Comparative Example 1

—Preparation of Toner 7—

Toner 7 was prepared in the same manner as in Example 1, except that 1.0 part by mass of Silica RX200 (by Nippon Aerosil Co., Ltd.) were added to 100 parts by mass of the toner base A and mixed by means of a HENSCHEL MIXER at the peripheral velocity of 40 m/sec. for 5 minutes in Example 1.

Comparative Example 2

—Preparation of Toner 8—

Toner 8 was prepared in the same manner as in Example 1, except that 0.8 parts by mass of forsterite D (average secondary particle diameter of 3.61 μm, average primary particle diameter of 1.66 μm) and 1.0 part by mass of Silica RX200 (by Nippon Aerosil Co., Ltd.) were added to 100 parts by mass of the toner base A and mixed by means of a HENSCHEL MIXER at the peripheral velocity of 40 m/sec. for 5 minutes in Example 1.

Comparative Example 3

—Preparation of Toner 9—

Toner 9 was prepared in the same manner as in Example 2, except that 1.0 part by mass of Silica RX200 (by Nippon Aerosil Co., Ltd.), and 0.8 parts by mass of strontium titanate A were added to 100 parts by mass of the toner base B and mixed by means of a HENSCHEL MIXER at the peripheral velocity of 40 m/sec. for 5 minutes in Example 2.

<Image Formation>

4,000 sheets of a specific pattern at a printing ratio of 5% were repeatedly printed under normal temperature and pressure environment (23° C., Relative Humidity of 45%), supplying a toner cartridge of an image-forming apparatus (IP-SiO CX2500 manufactured by Ricoh Company, Ltd.) with the each obtained toner.

<Condition of Developing Roller and Image Quality>

The condition of a developing roller and an image quality after image-forming were visually observed and evaluated according to the following standard. The results are shown in FIG. 3.

[Evaluation Standard]

A: no streaks or one to two streaks are found on the developing roller, but there is no problem in the image quality.

B : several streaks are found on the developing roller, and streak defects are seen in the image quality, but there is not practical problem.

C: many streaks are generated on the developing roller, and many streak defects are generated in the image quality, or toner spillage is occurred, thus there is a practical problem.

<Measuring Content and Residual Ratio of Compound oxide>

The remaining toner in a toner cartridge was taken out before the image-forming (at the beginning) and after the continuous image-forming on 4,000 sheets, and the content and residual ratio of the compound oxide or strontium titanate in the toner was measured as follows. The results are shown in Table 3.

—Content of Compound oxide and Strontium Titanate—

The content of the magnesium silicate as the compound oxide was, for example, determined from the amount of the Mg element contained in the toner by fluorescent X-ray analysis. For quantitative determination, an analytical curve was obtained from a standard sample in which the content of the magnesium silicate was charged, and determined.

In addition, the content of the strontium titanate was determined from the amount of the Sr element in the same way as the magnesium silicate.

—Residual Ratio of Compound Oxide in the Toner—

The residual ratio of the magnesium silicate as the compound oxide in the toner can be measured by the method disclosed in Japanese Patent (JP-B) Nos. 3186325 and 3129074. Specifically, 2 g of the toner were added to 40 ml of 0.2 mass % of a surfactant (polyoxyalkylene alkyl ether, ET-165 by Dai-Ichi Kogyo Seiyaku Co, Ltd.) aqueous solution and then the toner were dispersed sufficiently so as to be wet in the surfactant aqueous solution. To this surfactant aqueous solution, the ultrasonic vibration with the frequency of 20 kHz was applied with 40 W output for one minute. Subsequently, the toner was collected through filtration and dried, and then the content of the magnesium silicate was determined by fluorescent X-ray analysis device (ZSX Primus by Rigaku Corporation). The ratio (residual ratio) of the residual magnesium silicate in the toner were determined by comparing the content of the magnesium silicate before applying ultrasonic vibration with that after applying ultrasonic vibration.

and a stable printing is maintained in comparison with that of Comparative Examples 1 to 3.

The toner of the present invention does not cause toner spillage from the developing unit and formation of streaks on the toner bearing member due to operation of the image-forming apparatus for a long period of time, and does not impair image quality. Therefore, the toner can be used widely in the printers and MFPs which are used in Small Office Home Office (SOHO) or placed dispersively in an office.

What is claimed is:

1. A toner comprising, at least:

a toner base comprising a binder resin and a colorant, and an inorganic fine particle, wherein the inorganic fine particle comprises a compound oxide expressed by the following Composition Formula (1):

$$[M1]_a Si_b O_c \qquad \text{Composition Formula (1)}$$

where "M1" represents a metal element selected from Sr, Mg, Zn, Co, Mn and Ce, "a" and "b" each represents an integer of 1 to 9 and "c" represents an integer of 3 to 9, wherein an average primary particle diameter of the compound oxide is 0.05 μm to 1.2 μm, wherein an average secondary particle diameter of the compound oxide is 0.08 μm to 3.5 μm, where the secondary particle is an aggregate of the primary particles.

2. The toner according to claim 1, wherein the compound oxide adheres to a surface of the toner base in the state of the secondary particle which is the aggregate of the primary particles.

3. The toner according to claim 1, wherein a Mohs hardness of the compound oxide is 4.5 to 8.

TABLE 3

| | | | external additives | | | mixing condition of HENSCHEL MIXER | | content of complex oxide (mass %) | | residual ratio of complex oxide (%) | | state of developing roller and image quality |
|---|---|---|---|---|---|---|---|---|---|---|---|---|
| | Toner | Toner base | complex oxide | additive 1 | additive 2 | peripheral velocity (m/sec) | mixing time (min.) | at the beginning | after printing 4,000 sheets | at the beginning | after printing 4,000 sheets | |
| Ex. 1 | Toner 1 | A | forsterite A 0.8 parts | RX-100 1.0 part | — | 40 | 5 | 0.76 | 0.79 | 65 | 82 | A |
| Ex. 2 | Toner 2 | B | forsterite A 1.1 parts | RX-100 1.0 part | — | 40 | 5 | 0.96 | 1.09 | 62 | 80 | A |
| Ex. 3 | Toner 3 | A | forsterite A 1.5 parts | RX-100 1.1 parts | — | 40 | 6 | 1.38 | 1.32 | 55 | 72 | A |
| Ex. 4 | Toner 4 | B | forsterite B 1.5 parts | RX-100 1.0 part | — | 40 | 7 | 1.42 | 1.38 | 58 | 63 | A |
| Ex. 5 | Toner 5 | A | forsterite C 1.2 parts | RX-100 1.5 parts | — | 40 | 8 | 1.08 | 0.90 | 49 | 56 | B |
| Ex. 6 | Toner 6 | A | enstatite A 0.8 parts | RX-100 1.0 part | — | 40 | 5 | 0.78 | 0.79 | 67 | 81 | A |
| Comp. Ex. 1 | Toner 7 | A | — | RX-100 1.0 part | — | 40 | 5 | 0 | 0 | — | — | C |
| Comp. Ex. 2 | Toner 8 | A | forsterite D 0.8 parts | RX-100 1.0 part | — | 40 | 5 | 0.74 | 0.27 | 36 | 92 | C |
| Comp. Ex. 3 | Toner 9 | B | — | RX-100 1.0 part | strontium titanate A 0.8 parts | 40 | 5 | 0 | 0 | — | — | C |

From the result of Table 3, it is determined that the toner of Examples 1 to 6 can provide an image in which an image quality is not impaired in spite of use for a long period of time

4. The toner according to claim 1, wherein the compound oxide has a relative permittivity of 2 to 10 measured at 1 MHz AC and a volume resistivity of $1.0\times10^{11}$ Ω·cm or more.

5. The toner according to claim 1, wherein the toner has a residual ratio of the compound oxide of 30% to 80%.

6. The toner according to claim 1, wherein the compound oxide is magnesium silicate expressed by the following Formula (2):

$$Mg_aSi_bO_c \qquad \text{Formula (2)}$$

where "a" and "b" each represents an integer of 1 to 9, and "c" represents a+2b.

7. The toner according to claim 6, wherein the magnesium silicate is at least one selected from forsterite, enstatite, and steatite.

8. The toner according to claim 1, wherein a content of the compound oxide in the toner is 0.1 mass % to 5.0 mass %.

9. The toner according to claim 1, wherein the toner is a nonmagnetic one-component developer.

* * * * *

UNITED STATES PATENT AND TRADEMARK OFFICE

CERTIFICATE OF CORRECTION

PATENT NO. : 7,749,671 B2
APPLICATION NO. : 11/521385
DATED : July 6, 2010
INVENTOR(S) : Atsushi Yamamoto et al.

It is certified that error appears in the above-identified patent and that said Letters Patent is hereby corrected as shown below:

On the title page, Item (75), the seventh inventor's city of residence information is incorrect. Item (75) should read:

-- Inventors: Atsushi Yamamoto, Kawanishi-shi (JP)
Masahide Inoue, Katsuragi-shi (JP)
Chiyoshi Nozaki, Otsu-shi (JP)
Minoru Nakamura, Takarazuka-shi (JP)
Masayuki Hagi, Minoo-shi (JP)
Yoshihiro Mikuriya, Nishinomiya-shi (JP)
Tsuyoshi Nozaki, Ikeda-shi (JP)
Hiroaki Kato, Nagaokakyo-shi (JP)
Takuya Kadota, Kobe-shi (JP)
Katsunori Kurose, Takarazuka-shi (JP)
Hideaki Yasunaga, Ibaraki-shi (JP)
Yoshimichi Ishikawa, Itami-shi (JP) --

Signed and Sealed this

Sixteenth Day of November, 2010

David J. Kappos

David J. Kappos
*Director of the United States Patent and Trademark Office*